US005338092A

United States Patent [19]

Wiltsey et al.

[11] Patent Number: 5,338,092

[45] Date of Patent: Aug. 16, 1994

[54] DRAWSTRING SEAT COVER

[75] Inventors: Ronald A. Wiltsey, Sterling Heights; Eugene S. Dudash, Commerce Township, Oakland County, both of Mich.

[73] Assignee: Lear Seating Corporation, Southfield, Mich.

[21] Appl. No.: 33,831

[22] Filed: Mar. 19, 1993

[51] Int. Cl.[5] ..... A47C 31/02

[52] U.S. Cl. ..... 297/228.11; 297/218; 297/228.13

[58] Field of Search ..... 297/219.1, 219.11, 218, 297/228.11, 228.13, 229

[56] References Cited

U.S. PATENT DOCUMENTS

| | | | |
|---|---|---|---|
| 2,161,448 | 6/1939 | Bishop | 297/228.11 |
| 2,373,071 | 4/1945 | Waranch | 297/228.11 X |
| 2,644,510 | 7/1953 | Benmax . | |
| 3,233,253 | 2/1966 | Cauvin | 5/353.1 |
| 3,630,572 | 12/1971 | Homier | 297/454 |
| 4,396,227 | 8/1983 | Neilson | 297/228.11 |
| 4,693,511 | 9/1987 | Seltzer | 297/219 |
| 4,834,451 | 5/1989 | Meunier | 297/218 |
| 4,865,383 | 9/1989 | Sbaragli | 297/218 |
| 4,872,724 | 10/1989 | Deley | 297/218 |
| 5,150,947 | 9/1992 | Croshaw | 297/229 |

FOREIGN PATENT DOCUMENTS

| | | | |
|---|---|---|---|
| 1511646 | 2/1968 | France | 297/228.13 |
| 776484 | 6/1957 | United Kingdom | 297/228.13 |
| 1143275 | 2/1969 | United Kingdom | 297/219.1 |

*Primary Examiner*—Peter R. Brown

*Attorney, Agent, or Firm*—Reising, Ethington, Barnard, Perry & Milton

[57] ABSTRACT

A seat cover assembly (10) includes a seat envelope (14) surrounding a seat (12) with a drawstring sheath (18) attached to the seat envelope (14) and a slidable drawstring (20) therein. Front and rear attachment projections (38,40) are located on the seat (12) to facilitate attachment of the seat envelope (14) to the seat (12). The drawstring sheath (18) comprises a plurality of sheath sections (22) with openings (24) between adjacent sections (22) so that intermediate drawstring portions (62) may extend from the openings (24) and be secured to the rear attachment projections (40) on the seat (12).

11 Claims, 1 Drawing Sheet

FIG-1
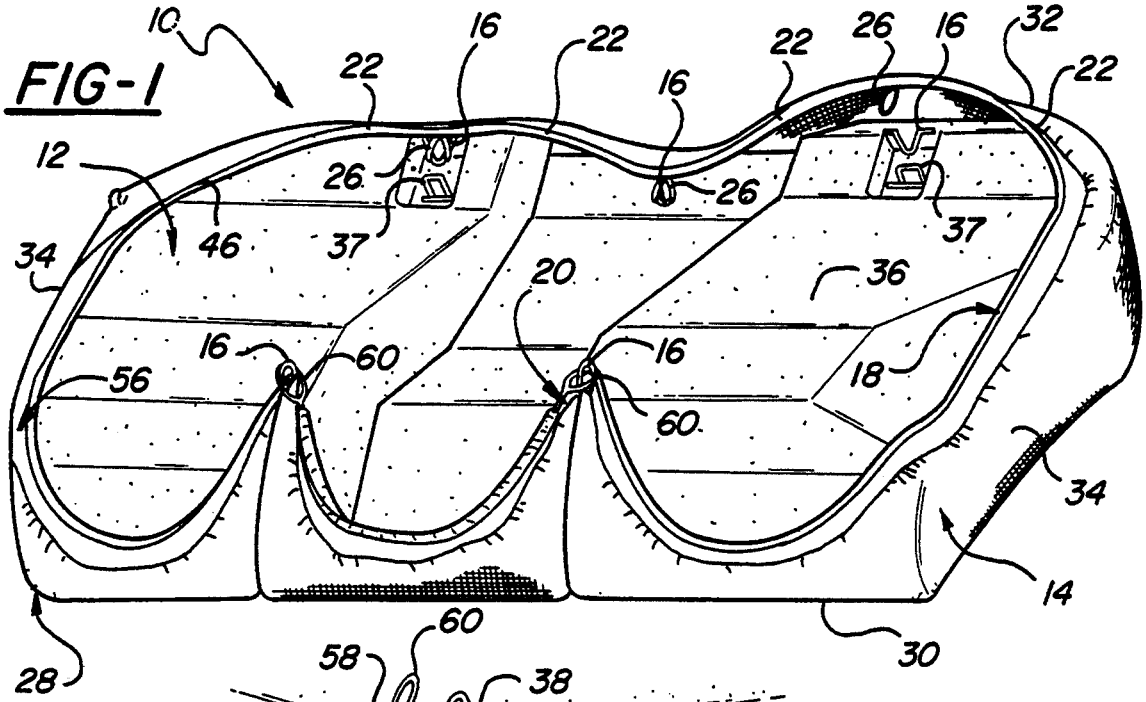
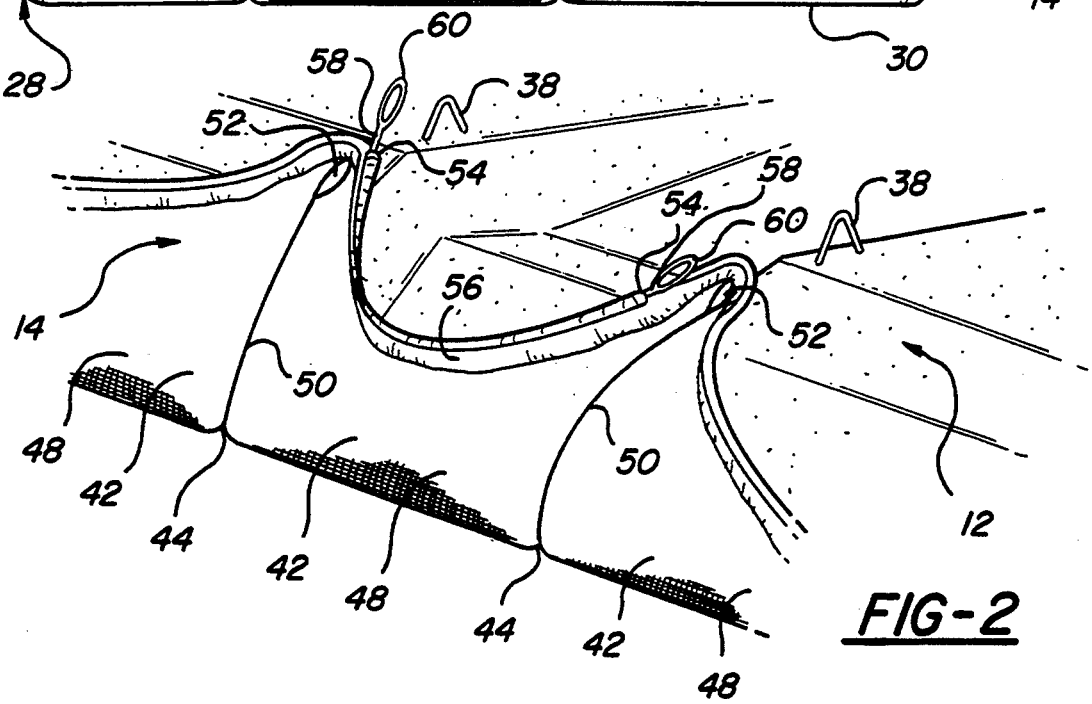
FIG-2
FIG-3
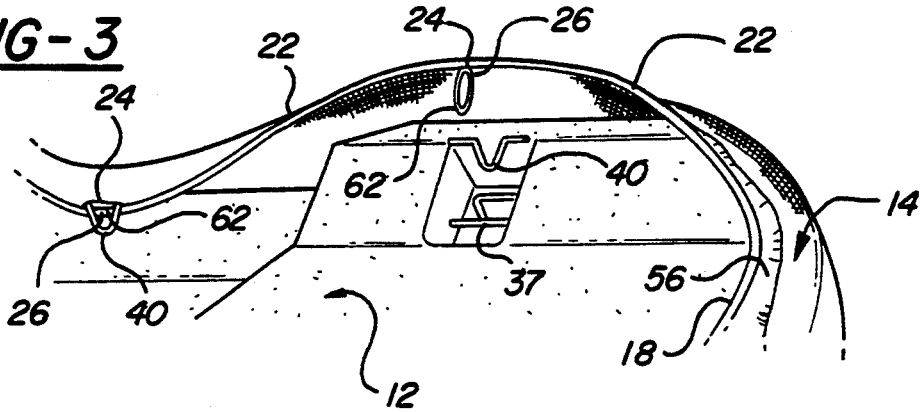

DRAWSTRING SEAT COVER

TECHNICAL FIELD

The subject invention generally relates to a seat cover, particularly a seat cover including a drawstring, for securely covering a seat and providing easy attachment thereto and removal therefrom.

BACKGROUND ART

Upholstery seat covers used at the manufacturing level provide a seat manufacturer with a multitude of options for decoratively covering a seat. In addition, seat covers are commonly used by consumers as an inexpensive and easy way to hide damaged or unattractive seat upholstery and also provide added cushioning to the seat. For all uses, it is desirable to provide a seat cover that will securely remain in place on the seat and yet is easy to attach and remove from the seat.

It has long been known that a drawstring assembly in a seat cover can provide ease of attachment and removal for the seat cover. For example, U.S. Pat. No. 2,161,448 to Bishop illustrates a seat cover of this type. The Bishop '448 seat cover discloses a fabric panel with a drawstring sheath attached to the outer periphery thereof. A drawstring is slidably disposed within the sheath and, when cinched, pulls the fabric panel tightly against a seat. Thus, by merely tying the cinched drawstring, the seat cover can be retained against the seat.

However, with continued use, a drawstring-type seat cover as shown in Bishop '448 will slide and wrinkle unattractively with respect to the seat because it is not attached directly to the seat. On the other hand, seat cover designs that securely retain the seat cover in place can be very labor intensive and difficult to install. For example, U.S. Pat. No. 2,644,510 to Benmax illustrates a seat cover of this type. The seat cover includes a fabric panel designed to cover a seat bottom. A plurality of holes are disposed along the outer periphery of the fabric panel, and an identical number of hooks are located along an outer edge of the underside of the seat bottom. After the fabric panel is placed over the seat bottom, the holes are placed over the hooks to securely retain the fabric panel against the seat.

Thus, the Benmax '510 seat cover will likely remain in place with respect to the seat without sliding and wrinkling. However, it is very difficult to install the seat cover due to the tension required in the fabric panel during installation. In other words, the fabric panel must be tightly held by an installer during attachment to the hooks in order to provide a tight fit of the seat cover after installation.

Further attempts to improve the drawstring-type seat cover have been made. For example, U.S. Pat. No. 5,150,947 to Croshaw illustrates an updated drawstring-type seat cover. The '947 seat cover includes a backrest cover and a seat bottom cover for covering, respectively, the backrest and seat bottom portions of a seat. The backrest cover and seat bottom cover are joined along a common seam, and a center panel is attached to the seam and extends through a crease between the backrest and seat bottom portions of the seat. The backrest cover and seat bottom cover each include a separate drawstring. After cinching, each drawstring is threaded through eyelets in the center panel and attached to hooks on the seat cover to retain the seat cover against the seat.

However, the Croshaw '947 seat cover still does not totally secure the seat cover in position against the seat to prevent wrinkling and sliding. Rather, the seat cover is free to move with respect to the seat and is not directly fixed thereto. In addition, the use of a center panel as in Croshaw '947 is inapplicable to a seat cover that covers only a seat bottom or only a backrest.

SUMMARY OF THE INVENTION AND ADVANTAGES

The present invention provides a seat cover assembly which can be easily attached and securely fastened to a seat and includes a seat envelope with a drawstring sheath attached to the seat envelope and a flexible drawstring slidably disposed within the drawstring sheath. The present invention is characterized by the drawstring sheath comprising a plurality of sheath sections defining an opening disposed between adjacent sections. The openings expose a portion of the drawstring therethrough so that the drawstring is extendable out of each of the openings and securable to an attachment device on the seat.

The invention also contemplates a method for easily and securely attaching a drawstring seat envelope to a seat. The method includes enveloping the seat with the seat envelope and cinching a drawstring on the seat envelope to draw the seat envelope tightly against the seat. Ends of the drawstring are extended outwardly from ends of a drawstring sheath. Intermediate portions of the drawstring are extended from intermediate openings in the drawstring sheath. The method is characterized by securing the intermediate portions of the drawstring to an attachment device on the seat.

The present invention permits simple attachment of a drawstring-type seat cover directly to a seat to prevent sliding and wrinkling of the seat cover with respect to the seat. By placing the seat cover in tension at various points and then anchoring the seat cover to the seat, the seat cover is prevented from relative motion with respect to the seat. Another advantage is that the drawstring can be attached to an attachment device on the seat prior to cinching the drawstring while the seat cover is still loose. Thus, the effort required for installation is minimal because the seat cover need not be manually held in tension during attachment to the attachment device.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a perspective view of the seat cover of the present invention disposed about a seat bottom as shown from the bottom of the seat;

FIG. 2 is an enlarged fragmentary view of the drawstring ends and the slits in the seat cover before attachment to the seat bottom; and FIG. 3 is an enlarged fragmentary view of an intermediate portion of the drawstring extending outwardly from the sheath before attachment to the seat bottom.

DETAILED DESCRIPTION OF THE PREFERRED EMBODIMENT

The present invention comprises a seat cover assembly 10 for providing an easily attached and securely fastened seat cover for a seat. The seat cover assembly 10 includes a seat 12, a seat envelope 14 disposed about the seat 12, and attachment means 16 disposed on the seat 12 for attaching the seat envelope 14 to the seat 12. A drawstring sheath 18 is attached to the seat envelope 14 and includes a flexible drawstring 20 slidably disposed therewithin. The invention is characterized by the drawstring sheath 18 including a plurality of sheath sections 22 defining an opening 24 disposed between adjacent sections 22 for exposing a portion 26 of the drawstring 20 therethrough. The drawstring 20 extends from the sheath 18 out of each of the openings 24 and is secured to the attachment means 16 on the seat 12.

As shown in FIG. 1, the seat 12 is a typical bench-type seat bottom for use in an automobile or other vehicle. However, the present invention is applicable to bucket seat bottoms or to backrests of any type as well. The seat 12 is shown inverted in FIG. 1 to better illustrate the attachment of the seat envelope 14 to the seat 12. The seat 12 includes an outer periphery 28 comprising a front edge 30, a rear edge 32, and two side edges 34. The seat 12 also includes a bottom surface 36 and a top surface (not shown). The seat 12 is formed of a foam material molded about a metal support frame (not shown). Two frame mounts 37 extend from the frame out of the seat 12 to permit attachment of the seat 12 to a vehicle or other apparatus.

The attachment means 16 on the seat 12 comprises a plurality of attachment projections 38,40 integrally connected to the seat frame and extending outwardly from the foam material of the seat 12. In the preferred embodiment, the seat 12 includes three adjacent and interconnected sections 42 with crevices 44 disposed therebetween. A front attachment projection 38 is disposed adjacent an end of each of the crevices 44 and proximate the front edge 30 of the seat 12. In addition, three rear attachment projections 40 are disposed adjacent the outer periphery 28 of the seat 12 along the rear edge 32 thereof. The attachment projections 38,40 are generally V-shaped in the preferred embodiment, although other shapes and configurations are certainly within the scope of the invention.

The seat envelope 14 comprises a fabric enclosure or pouch that surrounds and envelops the seat 12. More specifically, the seat envelope 14 covers the top surface in addition to the front, rear, and side edges 30,32,34 (i.e. the outer periphery 28) of the seat 12. The seat envelope 14 includes an outer periphery 46 which wraps around the outer periphery 28 of the seat 12 to partially cover the bottom surface 36 thereof. The seat envelope 14 includes three adjacent enclosures 48 that cover the three adjacent sections 42 of the seat 12. A valley 50 is disposed between adjacent enclosures 48. Specifically, a valley 50 is disposed within each crevice 44 in the seat 12. In other words, the seat envelope 14 acts in similar fashion to a glove to cover the seat 12, with the enclosures 48 acting as the "fingers" of the glove to surround and cover the "fingers", or sections 42, of the seat 12.

The seat envelope 14 also includes attachment slits 52 disposed therein for attachment of the seat envelope 14 to the attachment means 16. The attachment slits 52 are disposed adjacent the outer periphery 46 of the seat envelope 14, and in particular are disposed adjacent the valleys 50. In this manner, by placing the attachment slits 52 over the front attachment projections 38, the valleys 50 are retained within the crevices 44 against the seat 12. The attachment slits 52 comprise cuts or wedges removed from the material of the seat envelope 14 to provide an opening or eyelet through which an attachment projection 38,40 may be inserted. The attachment slits 52 in the preferred embodiment may be reinforced with stitching or additional fabric around the edges thereof, although in the preferred embodiment the slits 52 are not reinforced.

The drawstring sheath 18 is fixedly attached to the outer periphery 46 of the seat envelope 14 and is disposed along the entirety thereof. More specifically, the drawstring sheath 18 is attached to itself to form a loop or ring about the outer periphery 46 of the seat envelope 14. As best shown in FIG. 2, the drawstring sheath 18 includes first and second ends 56 which overlap along the outer periphery 46. The drawstring sheath 18 comprises a passage or tunnel for protecting and slidably guiding the drawstring 20. The sheath 18 is preferably made of cotton or any synthetic material that provides little resistance to sliding motion and yet remains durable. A ribbon 56 is attached to the sheath 18 along a longitudinal edge of the ribbon 56 and to the seat envelope 14 along an opposite longitudinal edge to secure the sheath 18 to the seat envelope 14. Alternatively, the sheath 18 and ribbon 56 could be a one piece member formed of a single piece of fabric material.

In FIG. 1, four sheath sections 22 with three openings 24 therebetween are shown. The openings 24 are disposed at spaced locations along the length and intermediate the ends 54 of the sheath 18. Specifically, the openings 24 are disposed adjacent the rear edge 32 of the seat 12 adjacent the rear attachment projections 40. In the preferred embodiment, the openings 24 provide only a partial break or hole in the sheath 18. In other words, the sheath 18 remains a continuous member with only small gaps disposed along the length thereof. In the alternative, the sheath 18 could comprise a plurality of discrete sheath sections 22 with the openings 24 comprising a complete break in the continuity of the sheath member 18.

As shown best in FIG. 2, the drawstring 20 includes first and second ends 58 extending respectively from the first and second ends 54 of the sheath 18. The drawstring ends 58 each include a loop 60 disposed thereon. The loops 60 are placed over the front attachment projections 38 adjacent the seat crevices 44 after the drawstring 20 is cinched. In this manner, the drawstring 20 can be secured in a cinched position without the need for tying the first and second ends 58 of the drawstring 20 together. The drawstring 20 includes an intermediate portion 62 disposed between the first and second ends 58. The intermediate portion 62 extends from the openings 24 in the sheath 18 to permit attachment of the drawstring 20 to the rear attachment projections 40 on the seat 12.

The seat envelope 14 is attached to the seat 12 in the following manner. First, the seat 12 is enveloped with the seat envelope 14 such that the seat envelope 14 covers the top surface (not shown) of the seat 12 and the front, rear, and side edges 30,32,34 thereof as shown in FIG. 1. Thus, the outer periphery 46 of the seat envelope 14 as well as the drawstring sheath 18 attached thereto define an opening in the seat envelope 14 adjacent the bottom surface 36 of the seat 12 and proximate the outer periphery 28 of the seat 12.

Next, intermediate portions 62 of the drawstring 20 are extended from the intermediate openings 24 in the sheath 18. The intermediate portions 62 of the drawstring 20 are then secured to the rear attachment projections 40 on the seat 12, as shown in FIGS. 1 and 3. The valleys 50 in the seat envelope 14 are drawn within the crevices 44 in the seat 12 such that the enclosures 48 in the seat envelope 14 cover the sections 42 of the seat 12 as shown in FIG. 2. The attachment slits 52 are then placed over the front attachment projections 38 to maintain the valleys 50 within the crevices 44.

The ends 58 of the drawstring 20 are extended from the ends 54 of the sheath 18 and are cinched in an overlapping fashion to draw the seat envelope 14 tightly against the seat 12. As the drawstring ends 58 are pulled, the effective length of the drawstring 20 within the sheath 18 is reduced. The sheath 18 must therefore constrict in response to the cinching to accommodate the decrease in length of the drawstring 20. Accordingly, the outer periphery 46 of the seat envelope 14 along with the sheath 18 are pulled which thereby tightens the fit of the seat envelope 14 against the seat 12. After cinching the drawstring 20, the loops 60 on the drawstring ends 58 are attached to the front attachment projections 38 on the seat 12. In the alternative, the drawstring ends 58 could be tied to the front attachment projections 38.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A seat cover assembly (10) for providing an easily attached and securely fastened seat cover for a seat, said seat cover assembly (10) including:

a seat (12);

said seat (12) including a top surface, a bottom surface (36), and an outer periphery (28);

said outer periphery (28) including a front peripheral edge (30), a rear peripheral edge (32) directly opposing said front peripheral edge (30), and two opposing side peripheral edges (34);

a seat envelope (14) disposed about said seat (12);

a drawstring sheath (18) attached to said seat envelope (14);

a flexible drawstring (20) including first and second ends and an intermediate portion slidably disposed within said drawstring sheath (18) and extending continuously through the entirety of said sheath (18);

said drawstring sheath (18) comprising a plurality of sheath sections (22) each including a first and second end;

a plurality of spaced openings (24) disposed along said sheath (18), with each said opening (24) disposed between a first end of one said section (22) and a second end of the next adjacent of said sections (22) of said sheath (18);

said intermediate portion (62) of said drawstring (20) extending outwardly from each of said spaced openings (24) in said sheath (18);

a plurality of attachment projections (16) each disposed at spaced locations on said bottom surface (36) of said seat (12) and adjacent one of said peripheral edges (30,32,34) thereof, with each said attachment projection (16) disposed adjacent one of said openings (24) in said sheath (18); and characterized by said attachment projections (16) each including a free distal end extending away from said adjacent peripheral edge (32) and toward an opposing peripheral edge (30) of said seat (12) for directly engaging and securely retaining said intermediate portion (62) of said drawstring (20) to prevent sliding and wrinkling of said seat envelope (14) with respect to said seat (12).

2. An assembly (10) as set forth in claim 1 further characterized by said drawstring ends (58) each including a loop (60) disposed thereon.

3. An assembly (10) as set forth in claim 1 further characterized by said seat (12) including a plurality of adjacent sections (42).

4. An assembly (10) as set forth in claim 3 further characterized by a crevice (44) disposed between adjacent said sections (42) of said seat (12).

5. An assembly (10) as set forth in claim 4 further characterized by said seat envelope (14) forming a plurality of enclosures (48) for covering said sections (42) of said seat (12).

6. An assembly (10) as set forth in claim 5 further characterized by a valley (50) disposed between adjacent said enclosures (48).

7. An assembly as set forth in claim 1 further characterized by each of said attachment projections (16) comprising a v-shaped projection (16).

8. A method for easily and securely attaching a drawstring seat envelope (14) to a seat (12) of the type having a plurality of attachment projections (16) disposed at spaced locations on a bottom surface (36) and adjacent a peripheral edge (30,32,34) of said seat (12), said method comprising:

enveloping the seat (12) with the seat envelope (14);

positioning the seat envelope (14) on the seat (12) such that the attachment projections (16) are each disposed adjacent an intermediate opening (24) in the drawstring sheath (18);

cinching the drawstring (20) on the seat envelope (14) to draw the seat envelope (14) tightly against the seat (12);

extending ends (58) of the drawstring (20) outwardly from ends (54) of the drawstring sheath (18);

extending a continuous intermediate portion (62) of the drawstring (20) disposed between the ends (58) thereof from the intermediate openings (24) in the drawstring sheath (18) disposed between the ends (54) of the sheath (18); and characterized by securing the intermediate portion (62) of the drawstring (20) to the attachment projections (16) on the seat (12) by engaging the intermediate portion (62) with a free distal end of each of the attachment projections (16) which extends away from the adjacent peripheral edge (32) and toward an opposing peripheral edge (30) of the seat (12).

9. A method as set forth in claim 8 wherein said seat includes a plurality of sections (42) with a crevice (44) formed therebetween, further characterized by drawing the seat envelope (14) within the crevice (44) in the seat (12).

10. A method as set forth in claim 8 further characterized by attaching looped ends (60) of the drawstring (20) to attachment projections (38) extending from the seat (12).

11. A method as set forth in claim 10 further characterized by cinching the drawstring ends (58) in an overlapping fashion.

* * * * *